US006837415B1

(12) United States Patent
Huang

(10) Patent No.: US 6,837,415 B1
(45) Date of Patent: Jan. 4, 2005

(54) FLOORING NAILER

(76) Inventor: Wen-Sheng Huang, 58 Ma Yuan West St., Taichung (TW)

( * ) Notice: Subject to any disclaimer, the term of this patent is extended or adjusted under 35 U.S.C. 154(b) by 0 days.

(21) Appl. No.: 10/676,440

(22) Filed: Sep. 29, 2003

(51) Int. Cl.[7] ..... B25C 1/04

(52) U.S. Cl. ..... 227/130; 227/147; 227/156; 81/489; 81/23

(58) Field of Search ..... 227/130, 147, 227/156, 8, 9; 173/170, 171; 81/489, 23; 16/110.1, 422, 426, 438

(56) References Cited

U.S. PATENT DOCUMENTS 3,133,311 A * 5/1964 Riebsamen ..... 16/110.1
3,360,176 A * 12/1967 Gehl et al. ..... 227/156
3,897,607 A * 8/1975 Schaffer et al. ..... 16/422
4,346,831 A * 8/1982 Haytayan ..... 227/156
4,570,840 A * 2/1986 Bull ..... 227/8
5,509,489 A * 4/1996 Lower, Jr. ..... 173/170
5,558,570 A * 9/1996 Nakamura et al. ..... 16/426
6,095,392 A * 8/2000 Batts et al. ..... 227/8
6,155,472 A * 12/2000 Deziel ..... 227/8
6,318,620 B1 * 11/2001 Anstett et al. ..... 227/147
6,712,256 B1 * 3/2004 Curry ..... 227/111

* cited by examiner

*Primary Examiner*—Stephen F. Gerrity
*Assistant Examiner*—Michelle Lopez
(74) *Attorney, Agent, or Firm*—Alan D. Kamrath; Nikolai & Mersereau, P.A.

(57) ABSTRACT

A flooring nailer includes a main body, and a handle structure mounted on the main body. The handle structure includes a fixing seat and a handle. Thus, the snapping portion of the handle is locked in the locking portion of the fixing seat to form a first locking effect, and the tapered face of the support rack of the fixing seat is rested on the tapered face of the pivot shaft of the handle to form a second locking effect, so that the handle is fixed on the fixing seat rigidly and stably, thereby preventing the handle structure from detaching from the main body due to the shock or vibration produced during operation of the flooring nailer.

12 Claims, 7 Drawing Sheets

FLOORING NAILER

BACKGROUND OF THE INVENTION

1. Field of the Invention

The present invention relates to a flooring nailer, and more particularly to a flooring nailer, wherein the handle is fixed on the fixing seat rigidly and stably, thereby preventing the handle structure from detaching from the main body due to the shock or vibration produced during operation of the flooring nailer.

2. Description of the Related Art

A conventional flooring nailer in accordance with the prior art shown in FIG. 9 comprises a main body 60, and a handle 63 mounted on the main body 60. The main body 60 has a first end provided with a nail striking portion 61 and a second end provided with a nail outlet 611 for ejecting the flooring nails (not shown) outward by striking the nail striking portion 61 by a hammer (not shown). The main body 60 has a side formed with a protruding transverse bar 62. The handle 63 has a lower end provided with an L-shaped support plate 64 secured on the transverse bar 62 of the main body 60 by two L-shaped screw members 66.

However, the support plate 64 of the handle 63 is mounted on the transverse bar 62 of the main body 60 by the two screw members 66 only, so that the handle 63 is not supported on the main body 60 rigidly and stably. Thus, the handle 63 is easily detached from the main body 60 due to the shock or vibration produced during operation of the flooring nailer.

SUMMARY OF THE INVENTION

The primary objective of the present invention is to provide a flooring nailer having a movably foldable handle structure.

Another objective of the present invention is to provide a flooring nailer, wherein the snapping portion of the handle is locked in the locking portion of the fixing seat to form a first locking effect, and the tapered face of the support rack of the fixing seat is rested on the tapered face of the pivot shaft of the handle to form a second locking effect, so that the handle is fixed on the fixing seat rigidly and stably, thereby preventing the handle structure from detaching from the main body due to the shock or vibration produced during operation of the flooring nailer.

A further objective of the present invention is to provide a flooring nailer, wherein the handle of the handle structure can be pivoted relative to the fixing seat by the pivot shaft, so that the handle of the handle structure is parallel with the main body, thereby folding the handle structure so as to facilitate package, storage and transportation of the flooring nailer.

A further objective of the present invention is to provide a flooring nailer, wherein the spring is urged between the handle and the fixing seat to prevent the handle from detaching from the fixing seat.

A further objective of the present invention is to provide a flooring nailer, wherein the spring can absorb the shock or vibration produced during operation of the flooring nailer, thereby providing a shock-absorbing effect.

In accordance with the present invention, there is provided a flooring nailer, comprising a main body, and a handle structure mounted on the main body, wherein:

the handle structure includes a fixing seat, and a handle, wherein:

the fixing seat of the handle structure has a first end formed with a locking portion; and the handle of the handle structure is combined with the fixing seat and has a first end formed with a snapping portion snapped on the locking portion of the fixing seat.

Further benefits and advantages of the present invention will become apparent after a careful reading of the detailed description with appropriate reference to the accompanying drawings.

DETAILED DESCRIPTION OF THE INVENTION

Figure 1:
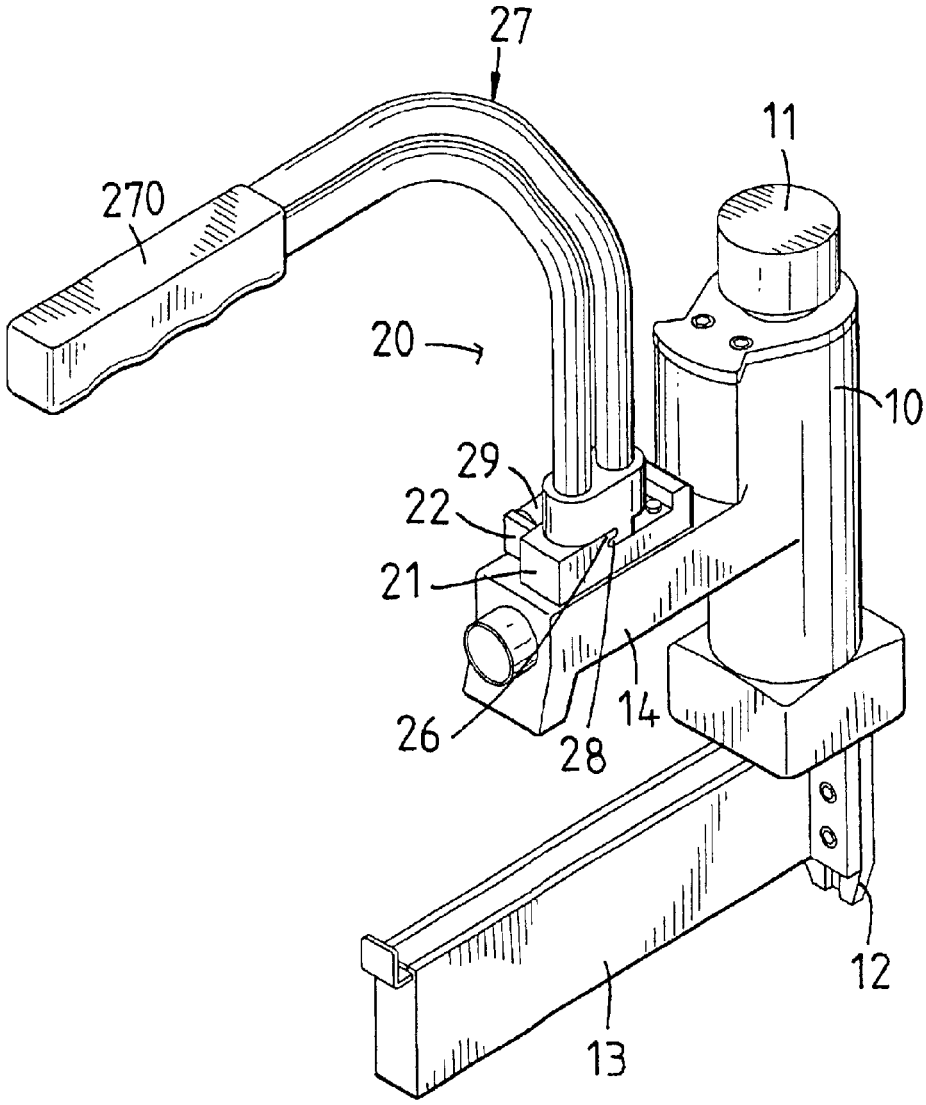
FIG. 1 is a perspective view of a flooring nailer in accordance with the preferred embodiment of the present invention.
Figure 2:
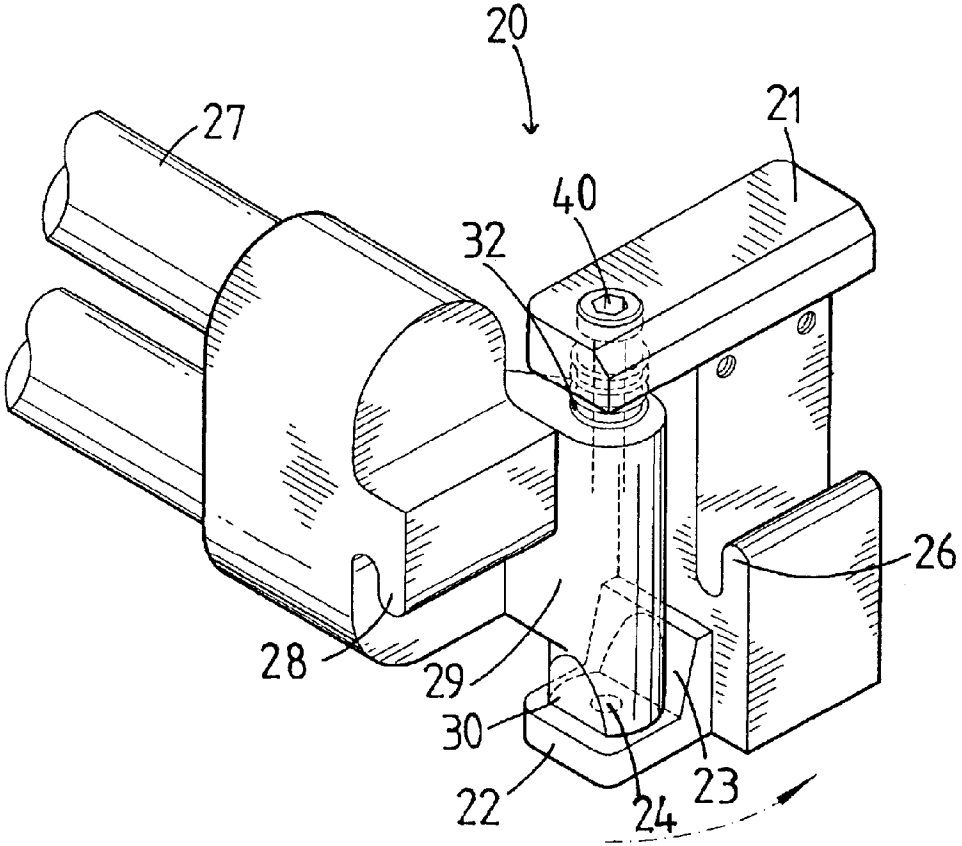
FIG. 2 is a partially cut-away perspective view of a handle structure of the flooring nailer in accordance with the preferred embodiment of the present invention.
Figure 3:
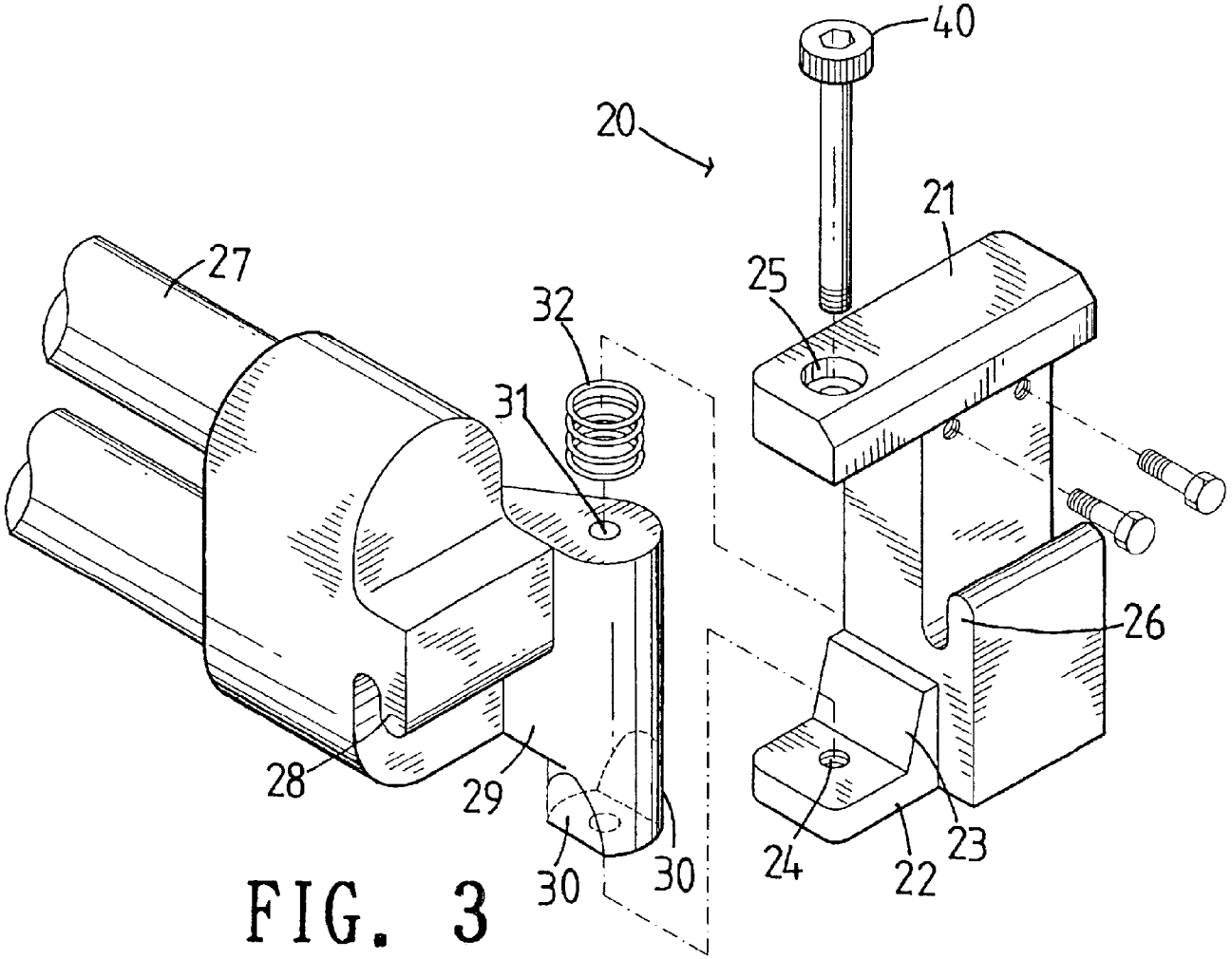
FIG. 3 is an exploded perspective view of the handle structure of the flooring nailer as shown in FIG. 2.

Referring to the drawings and initially to FIGS. 1–3, a flooring nailer in accordance with the preferred embodiment of the present invention comprises a main body 10, and a handle structure 20 mounted on the main body 10.

The main body 10 has a first end provided with a nail striking portion 11 and a second end provided with a nail outlet 12 for ejecting the flooring nails (not shown) outward by striking the nail striking portion 11 by a hammer not shown). The nail outlet 12 has a side provided with a receiving portion 13 for receiving the flooring nails. The main body 10 has a side formed with a protruding transverse bar 14.

The handle structure 20 includes a fixing seat 21, and a handle 27.

The fixing seat 21 of the handle structure 20 is secured on the transverse bar 14 of the main body 10. Preferably, the fixing seat 21 of the handle structure 20 is integrally formed with the transverse bar 14 of the main body 10. The fixing seat 21 of the handle structure 20 has a first end formed with a substantially L-shaped locking portion 26 and a second end formed with a counterbore 25. The fixing seat 21 of the handle structure 20 has a side formed with a substantially L-shaped support rack 22 located adjacent to the locking portion 26. The support rack 22 of the fixing seat 21 has a first section formed with a tapered face 23 located adjacent to the locking portion 26 and a second section formed with a screw bore 24 aligning with the counterbore 25.

The handle 27 of the handle structure 20 is combined with the fixing seat 21 and has a first end formed with a substantially L-shaped snapping portion 28 snapped on the locking portion 26 of the fixing seat 21 and a second end formed with a grip portion 270. The handle 27 of the handle structure 20 has a side formed with a cylindrical pivot shaft 29 located adjacent to the snapping portion 28 and pivotally mounted on the support rack 22 of the fixing seat 21. The pivot shaft 29 of the handle 27 has an end having two opposite sides each formed with a tapered face 30 rested on the tapered face 23 of the support rack 22 of the fixing seat 21. The pivot shaft 29 of the handle 27 is formed with a through hole 31.

The handle structure 20 further includes a screw member 40 extended through the counterbore 25 of the fixing seat 21 and the through hole 31 of the pivot shaft 29 of the handle 27, and screwed into the screw bore 24 of the support rack 22 of the fixing seat 21, so that the pivot shaft 29 of the handle 27 is pivotally mounted on the support rack 22 of the fixing seat 21.

The handle structure 20 further includes a spring 32 mounted on the screw member 40 and urged between a wall of the counterbore 25 of the fixing seat 21 and an end face of the pivot shaft 29 of the handle 27 for urging the pivot shaft 29 of the handle 27 toward the support rack 22 of the fixing seat 21.

Figure 5:
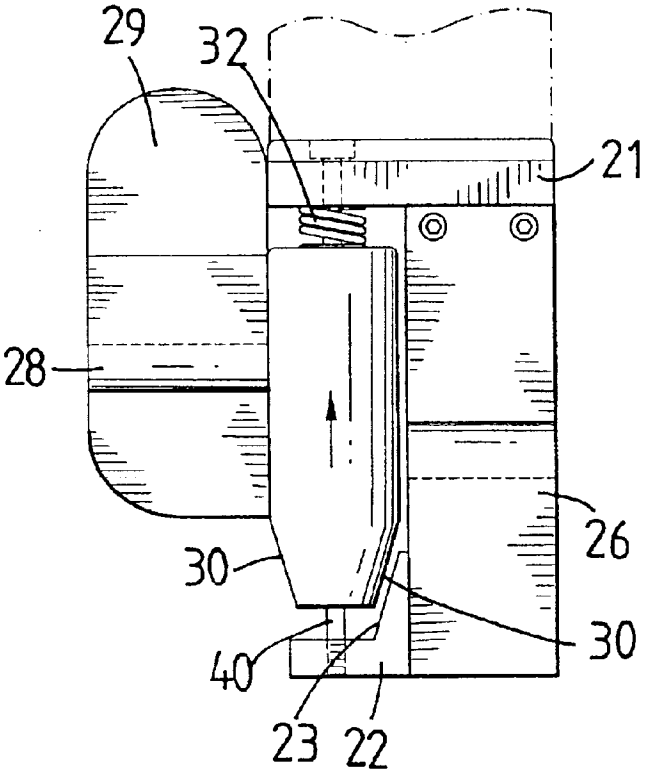
FIG. 5 is a schematic operational view of the handle structure of the flooring nailer as shown in FIG. 4.
Figure 4:
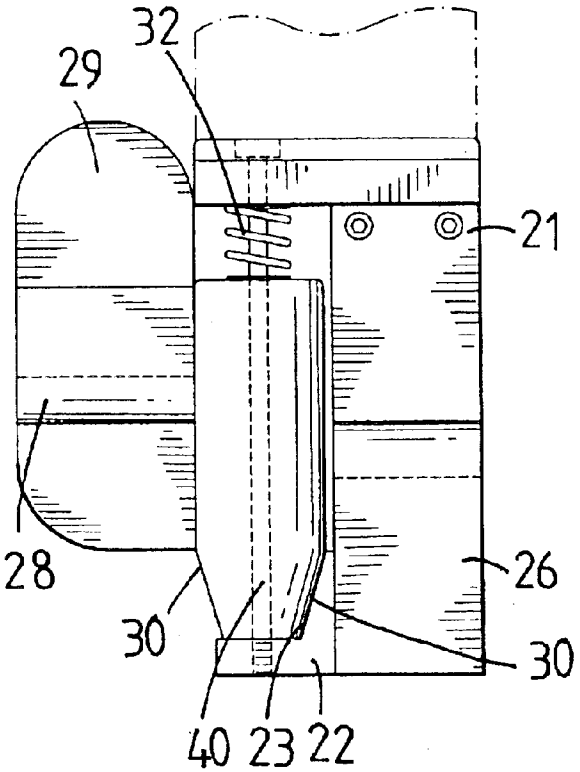
FIG. 4 is a plan view of the handle structure of the flooring nailer as shown in FIG. 2.
Figure 6:
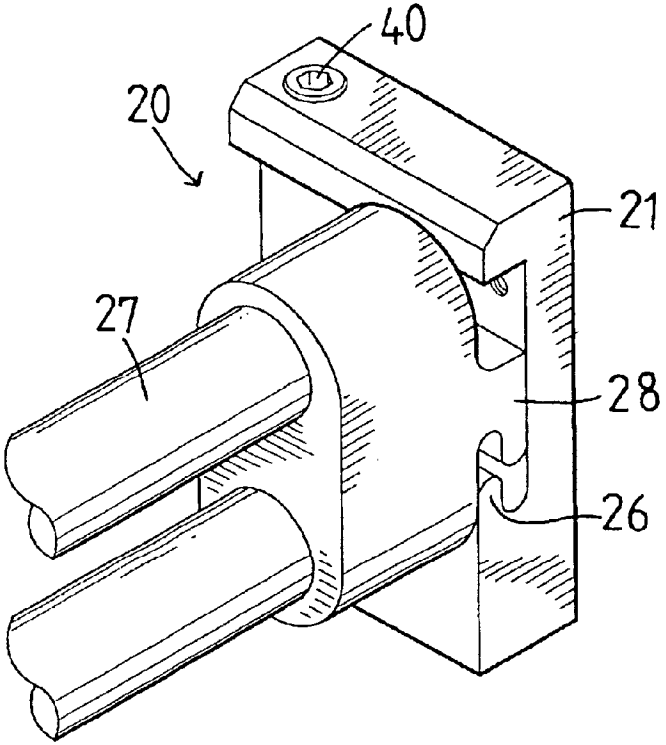
FIG. 6 is a schematic operational view of the handle structure of the flooring nailer as shown in FIG. 2.

In operation, referring to FIGS. 1–7, the tapered face 23 of the support rack 22 of the fixing seat 21 is rested on the tapered face 30 of one side of the pivot shaft 29 of the handle 27 as shown in FIG. 2. Then, the handle 27 is rotated relative to the fixing seat 21, so that the pivot shaft 29 of the handle 27 is pivoted relative to the support rack 22 of the fixing seat 21 to detach the tapered face 23 of the support rack 22 of the fixing seat 21 from the tapered face 30 of one side of the pivot shaft 29 of the handle 27. After the handle 27 is rotated relative to the fixing seat 21 through 90 degrees, the snapping portion 28 of the handle 27 is rested on the locking portion 26 of the fixing seat 21. Then, the handle 27 is lifted relative to the fixing seat 21 to compress the spring 32, so that the snapping portion 28 of the handle 27 is located above the locking portion 26 of the fixing seat 21 as shown in FIG. 5. Then, the handle 27 is rotated relative to the fixing seat 21 successively. After the handle 27 is rotated relative to the fixing seat 21 through 180 degrees, the snapping portion 28 of the handle 27 is aligned with the locking portion 26 of the fixing seat 21 as shown in FIG. 6.

Figure 7:
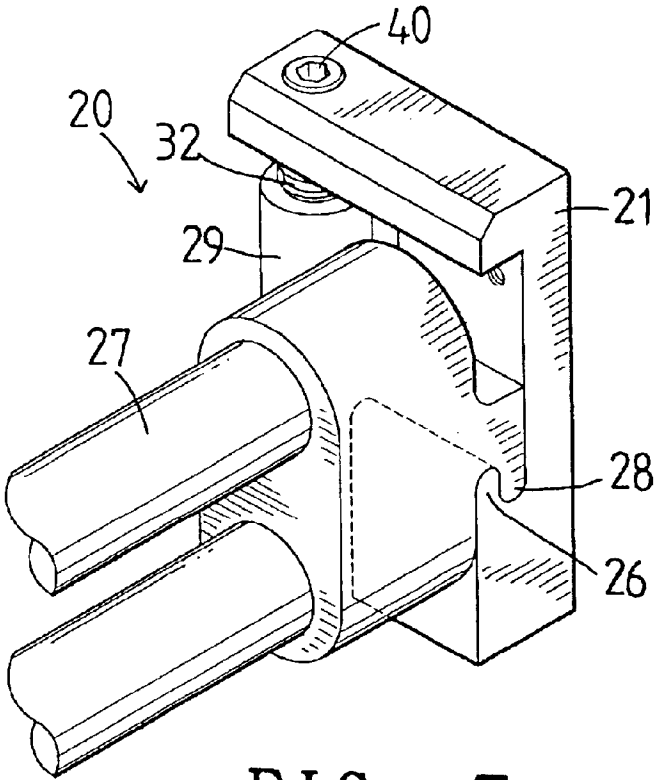
FIG. 7 is a schematic operational view of the handle structure of the flooring nailer as shown in FIG. 6.

Then, the lifting force applied on the handle 27 is released, so that the pivot shaft 29 of the handle 27 is moved toward the support rack 22 of the fixing seat 21 by the restoring force of the spring 32, and the snapping portion 28 of the handle 27 is moved into and locked in the locking portion 26 of the fixing seat 21 as shown in FIG. 7, thereby forming a first locking effect so as to fix the handle 27 on the fixing seat 21. At this time, the handle 27 is rotated relative to the fixing seat 21 through 180 degrees, so that the tapered face 23 of the support rack 22 of the fixing seat 21 is rested on the tapered face 30 of the other side of the pivot shaft 29 of the handle 27, thereby forming a second locking effect so as to fix the handle 27 on the fixing seat 21.

Accordingly, the snapping portion 28 of the handle 27 is locked in the locking portion 26 of the fixing seat 21 to form a first locking effect, and the tapered face 23 of the support rack 22 of the fixing seat 21 is rested on the tapered face 30 of the pivot shaft 29 of the handle 27 to form a second locking effect, so that the handle 27 is fixed on the fixing seat 21 rigidly and stably, thereby preventing the handle structure 20 from detaching from the main body 10 due to the shock or vibration produced during operation of the flooring nailer. In addition, the handle 27 of the handle structure 20 can be pivoted relative to the fixing seat 21 by the pivot shaft 29, so that the handle 27 of the handle structure 20 is parallel with the main body 10, thereby folding the handle structure 20 so as to facilitate package, storage and transportation of the flooring nailer. Further, the spring 32 is urged between the handle 27 and the fixing seat 21 to prevent the handle 27 from detaching from the fixing seat 21. Further, the spring 32 can absorb the shock or vibration produced during operation of the flooring nailer, thereby providing a shock-absorbing effect.

Figure 8:
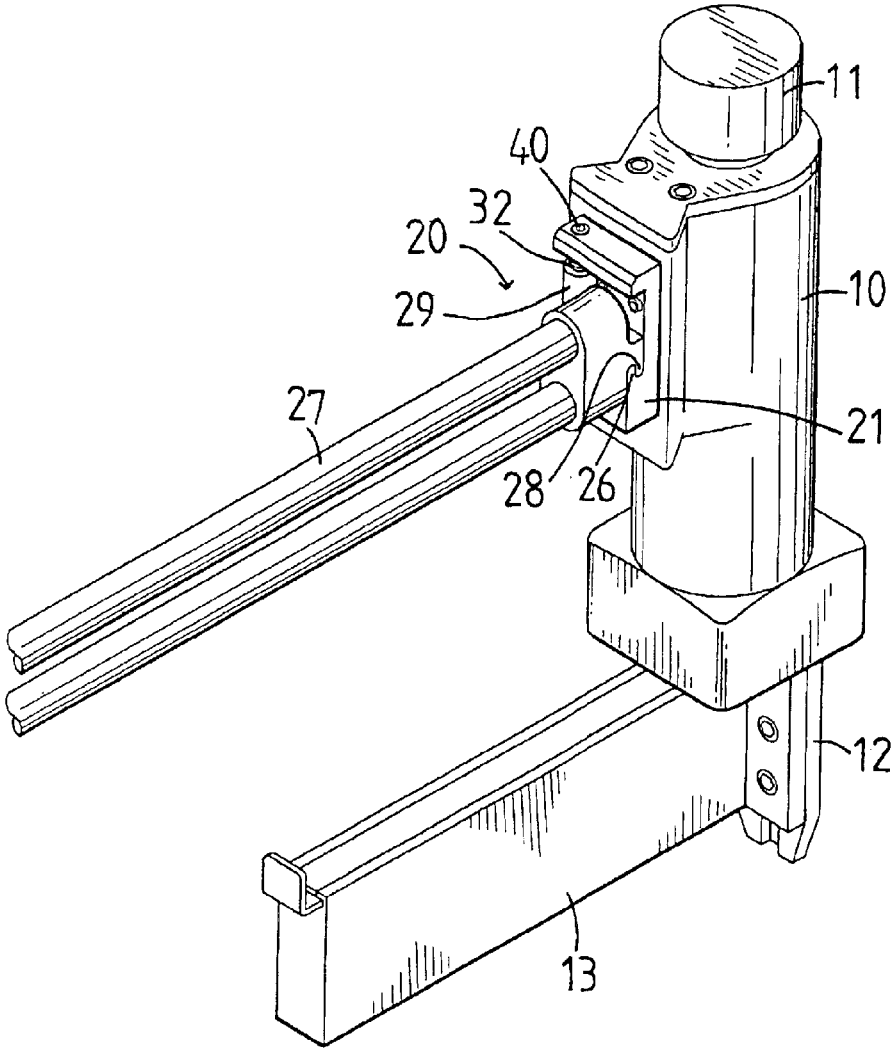
FIG. 8 is a perspective view of a flooring nailer in accordance with another embodiment of the present invention.
Figure 9:
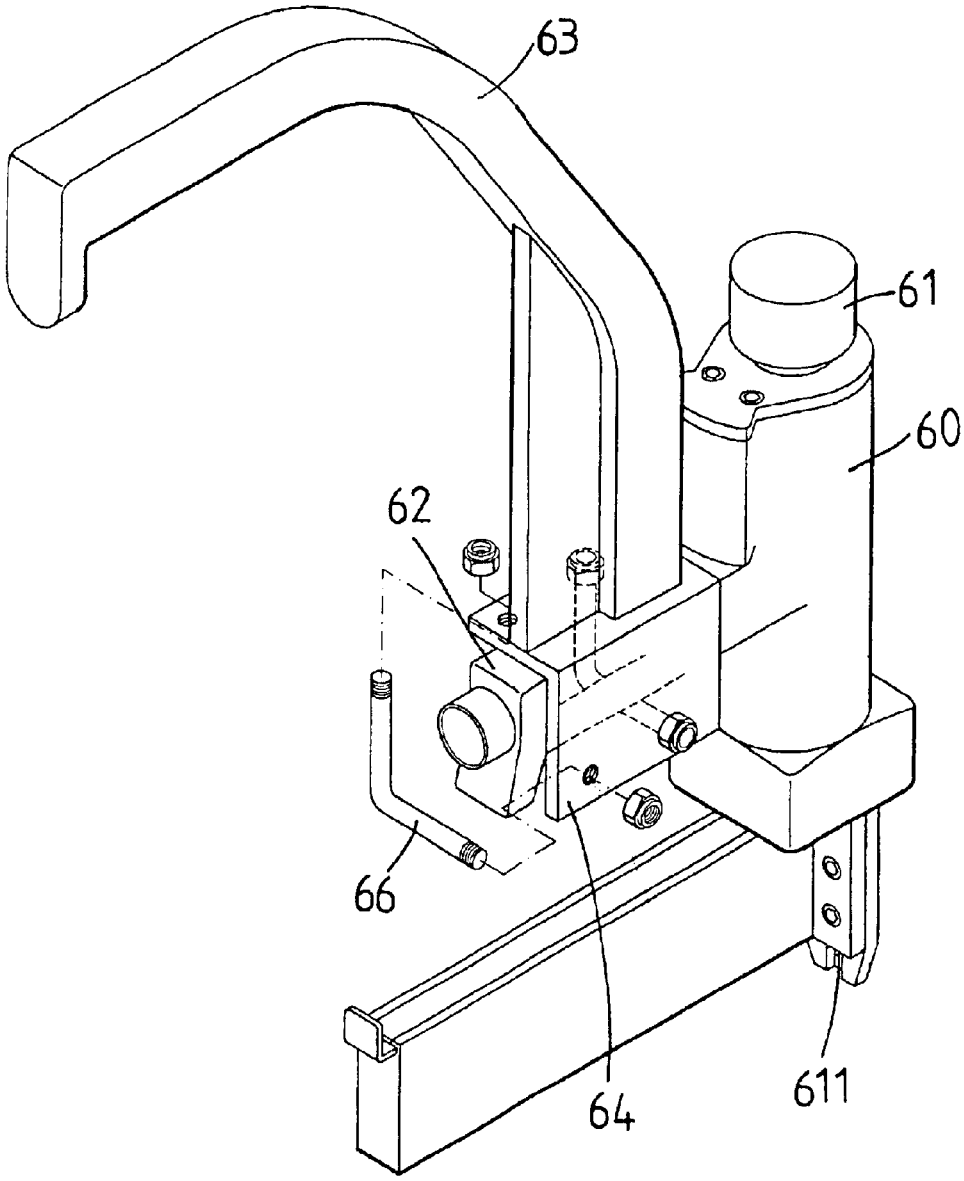
FIG. 9 PRIOR ART
FIG. 9 is a perspective view of a conventional flooring nailer in accordance with the prior art.

Referring to FIG. 8, a flooring nailer in accordance with another embodiment of the present invention is shown, wherein the fixing seat 21 of the handle structure 20 is secured on an outer wall of the main body 10.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A flooring nailer, comprising a main body, in combination with a handle structure mounted on the main body, wherein:

the main body has a side formed with a protruding transverse bar;

the handle structure includes a fixing seat, and a handle, wherein:

the fixing seat of the handle structure is secured on the transverse bar of the main body and has a first end formed with a locking portion; and the handle of the handle structure is combined with the fixing seat and has a first end formed with a snapping portion snapped on the locking portion of the fixing seat.

2. The flooring nailer in accordance with claim 1, wherein the locking portion of the fixing seat is substantially L-shaped.

3. The flooring nailer in accordance with claim 1, wherein the snapping portion of the handle is substantially L-shaped.

4. The flooring nailer in accordance with claim 1, wherein the fixing seat of the handle structure has a side formed with a support rack located adjacent to the locking portion, and the handle of the handle structure has a side formed with a pivot shaft pivotally mounted on the support rack of the fixing seat.

5. The flooring nailer in accordance with claim 4, wherein the support rack of the fixing seat is substantially L-shaped.

6. The flooring nailer in accordance with claim 4, wherein the support rack of the fixing seat has a first section formed with a tapered face located adjacent to the locking portion, and the pivot shaft of the handle has an end having two opposite sides each formed with a tapered face rested on the tapered face of the support rack of the fixing seat.

7. The flooring nailer in accordance with claim 4, wherein the fixing seat of the handle structure has a second end formed with a counterbore, the support rack of the fixing seat has a second section formed with a screw bore aligning with the counterbore, the pivot shaft of the handle is formed with a through hole, and the handle structure further includes a screw member extended through the counterbore of the fixing seat and the through hole of the pivot shaft of the handle, and screwed into the screw bore of the support rack of the fixing seat, so that the pivot shaft of the handle is pivotally mounted on the support rack of the fixing seat.

8. The flooring nailer in accordance with claim 7, wherein the handle structure further includes a spring mounted on the screw member and urged between a wall of the counterbore of the fixing seat and an end face of the pivot shaft of the handle urging the pivot shaft of the handle toward the support rack of the fixing seat.

9. The flooring nailer in accordance with claim 4, wherein the pivot shaft of the handle is located adjacent to the snapping portion.

10. The flooring nailer in accordance with claim 4, wherein the pivot shaft of the handle has a cylindrical shape.

11. The flooring nailer in accordance with claim 1, wherein the handle of the handle structure has a second end formed with a grip portion.

12. The flooring nailer in accordance with claim 1, wherein the fixing seat of the handle structure is secured on an outer wall of the main body.

* * * * *